US007579763B2

(12) United States Patent
Ahn

(10) Patent No.: US 7,579,763 B2
(45) Date of Patent: Aug. 25, 2009

(54) ELECTRON EMISSION DEVICE HAVING ELECTRODES WITH LINE PORTIONS AND SUBSIDIARY ELECTRODE

(75) Inventor: Sang-Hyuck Ahn, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 494 days.

(21) Appl. No.: 11/391,753

(22) Filed: Mar. 28, 2006

(65) Prior Publication Data

US 2007/0029922 A1 Feb. 8, 2007

(30) Foreign Application Priority Data

Mar. 31, 2005 (KR) ..... 10-2005-0026990

(51) Int. Cl.
*H01J 9/02* (2006.01)

(52) U.S. Cl. ..... 313/310; 313/495

(58) Field of Classification Search ..... 313/308–311, 313/495–497; 445/49–51

See application file for complete search history.

(56) References Cited

U.S. PATENT DOCUMENTS

| | | | |
|---|---|---|---|
| 5,346,683 | A | 9/1994 | Green et al. |
| 5,404,070 | A | 4/1995 | Tsai et al. |
| 5,528,103 | A | 6/1996 | Spindt et al. |
| 5,633,561 | A | 5/1997 | Barker |
| 5,645,462 | A | 7/1997 | Banno et al. |
| 5,729,087 | A | 3/1998 | Chien |
| 6,057,637 | A | 5/2000 | Zettl et al. |
| 6,097,138 | A | 8/2000 | Nakamoto |
| 6,201,343 | B1 | 3/2001 | Spindt et al. |
| 6,486,599 | B2 | 11/2002 | Wang et al. |
| 6,617,798 | B2 | 9/2003 | Lee et al. |
| 6,621,232 | B2 | 9/2003 | Jo et al. |
| 6,624,566 | B2 | 9/2003 | Uemura et al. |

(Continued)

FOREIGN PATENT DOCUMENTS

EP 1 329 927 A1 7/2003

(Continued)

OTHER PUBLICATIONS

Patent Abstracts of Japan, Publication No. 10-125215, dated May 15, 1998, in the name of Hideo Makishima.

(Continued)

*Primary Examiner*—Toan Ton
*Assistant Examiner*—Bumsuk Won
(74) *Attorney, Agent, or Firm*—Christie Parker & Hale LLP

(57) ABSTRACT

An electron emission device includes a first substrate and a second substrate facing the first substrate. A first electrode and a second electrode are formed on the first substrate and insulated from each other. Electron emission regions are electrically connected to at least one of the first electrode or the second electrode. A phosphor layer is formed on the second substrate. An anode electrode is formed on a surface of the phosphor layer. An area of the electron emission regions is an emission area, and at least one of the first electrode or the second electrode includes a pair of line portions spaced apart from each other in parallel while interposing the emission area therebetween and a connector traversing the emission area to interconnect the pair of line portions.

17 Claims, 11 Drawing Sheets

U.S. PATENT DOCUMENTS

| | | | |
|---|---|---|---|
| 6,703,791 | B2 | 3/2004 | Azuma |
| 6,833,086 | B2 | 12/2004 | Kajiwara |
| 6,956,334 | B2 | 10/2005 | Oh |
| 7,064,493 | B2 | 6/2006 | Konishi |
| 7,227,311 | B2 | 6/2007 | Tsukamoto |
| 2001/0030507 | A1 | 10/2001 | Ono |
| 2002/0081380 | A1 | 6/2002 | Dillon et al. |
| 2002/0127169 | A1 | 9/2002 | Smalley et al. |
| 2003/0092207 | A1 | 5/2003 | Yaniv et al. |
| 2003/0141179 | A1 | 7/2003 | Yu et al. |
| 2004/0066132 | A1 | 4/2004 | Cho et al. |
| 2004/0070326 | A1 | 4/2004 | Mao et al. |
| 2004/0108515 | A1 | 6/2004 | Muroyama et al. |
| 2004/0173818 | A1 | 9/2004 | Cheng |
| 2004/0256975 | A1 | 12/2004 | Gao et al. |
| 2005/0023950 | A1 | 2/2005 | Yoon et al. |
| 2005/0127030 | A1 | 6/2005 | Watanabe et al. |
| 2005/0234263 | A1 | 10/2005 | Prato et al. |

FOREIGN PATENT DOCUMENTS

| | | |
|---|---|---|
| JP | 04-284324 | 10/1992 |
| JP | 06-084478 | 3/1994 |
| JP | 09-231919 | 9/1997 |
| JP | 09-265927 | 10/1997 |
| JP | 09-320456 | 12/1997 |
| JP | 10-125215 | 5/1998 |
| JP | 2000-36243 | 2/2000 |
| JP | 2000-123712 | 4/2000 |
| JP | 2000-223004 | 8/2000 |
| JP | 2001-035423 | 2/2001 |
| JP | 2002-508879 T | 3/2002 |
| JP | 2004-134185 | 4/2004 |
| JP | 2005-56818 | 3/2005 |

OTHER PUBLICATIONS

Patent Abstracts of Japan, Publication No. 2004-134185, dated Apr. 30, 2004, in the name of Junko Yotani et al.

Patent Abstracts of Japan, Publication No. 2005-056818, dated Mar. 3, 2005, in the name of Taiitsu In et al.

European Search Report dated Aug. 1, 2006 for EP 06112056.4, in the name of Samsung SDI Co., Ltd. corresponding to priority KR 10-2005-0026990.

Patent Abstracts of Japan for Publication No. 2000-036243; Date of Publication Feb. 2, 2000; in the name of Kamimura et al.

Patent Abstracts of Japan for Publication No. 2000-123712; Date of Publication Apr. 28, 2000; in the name of Baba et al.

Patent Abstracts of Japan for Publication No. 2000-223004; Date of Publication Aug. 11, 2000; in the name of Jin et al.

ELECTRON EMISSION DEVICE HAVING ELECTRODES WITH LINE PORTIONS AND SUBSIDIARY ELECTRODE

CROSS REFERENCE TO RELATED APPLICATION

This application claims priority to and the benefit of Korean Patent Application No. 10-2005-0026990, filed on Mar. 31, 2005, in the Korean Intellectual Property Office, the entire content of which is incorporated herein by reference.

BACKGROUND OF THE INVENTION

1. Field of the Invention

The present invention relates to an electron emission device, and in particular, to an electron emission device which has driving electrodes with improved shape at the cross regions thereof to lower capacitance value and to minimize (or reduce or prevent) signal delay.

2. Description of Related Art

Depending upon the kinds of electron sources, electron emission devices can be classified into those using hot cathodes, or those using cold cathodes.

Among the electron emission devices using the cold cathodes, there are a field emitter array (FEA) type, a surface conduction emission (SCE) type, a metal-insulator-metal (MIM) type, and a metal-insulator-semiconductor (MIS) type.

An FEA-type electron emission device includes first and second substrates for forming a vacuum chamber (or a vacuum vessel). Electron emission regions are formed on the first substrate together with cathode and gate electrodes as the driving electrodes for controlling the emission of electrons from the electron emission regions. Phosphor layers are formed on a surface of the second substrate facing the first substrate together with an anode electrode for placing the phosphor layers in a high potential state.

The cathode and gate electrodes cross over each other while interposing an insulating layer therebetween, and opening portions are formed at the gate electrodes and the insulating layer to correspond to the respective cross regions of the gate and the cathode electrodes. Electron emission regions are formed on the cathode electrodes within the opening portions.

A scanning signal voltage is applied to a cathode electrode (or a gate electrode), and a data signal voltage is applied to the other electrode (e.g., the gate electrode if the scanning signal voltage is applied to the cathode electrode or the cathode electrode if the scanning signal voltage is applied to the gate electrode). Electric fields are formed around the electron emission regions at pixels where the voltage difference between the cathode and gate electrodes exceeds a threshold value, and electrons are emitted from those electron emission regions. The emitted electrons are attracted by the high voltage applied to the anode electrode, and collide against the corresponding phosphor layers to emit light.

In operation, a signal distortion may be made at the electron emission device. The driving signals may be delayed due to the resistance of the driving electrodes and the parasitic capacitance between the driving electrodes. The signal delay is proportional to the resistance and the capacitance. The capacitance is directly proportional to the dielectric constant of the insulating layer and the dimension of the overlapped regions of the cathode and gate electrodes, but is inversely proportional to the thickness of the insulating layer.

In this connection, it has been conventionally proposed that subsidiary electrodes should be formed on the driving electrodes with a high conductive metallic material to reduce the resistance, and the insulating layer should be made to reduce the capacitance, that is, formed with a new insulating material having a low dielectric constant or with a large thickness.

However, the formation of the new insulating material for reducing the capacitance to minimize (or reduce or prevent) the signal delay involves a high material cost and repeated experiments to develop a new material, and hence, is not suitable for mass production.

Furthermore, especially with respect to the technique of increasing the thickness of the insulating layer to reduce the capacitance, when the insulating layer is wet-etched to form opening portions, inclined sides are formed at the opening portions due to the isotropic effect of the wet etching process so that the opening portions of the gate electrodes are enlarged in size. In this case, the distance between the electron emission regions and the gate electrodes is increased to thereby increase the corresponding driving voltages so that it becomes difficult to fabricate a high resolution display device. In addition, the uniformity in the emission of electrons for the pixels is deteriorated.

SUMMARY OF THE INVENTION

It is an aspect of the present invention to provide an electron emission device. The electron emission device lowers the capacitance by improving the shape of driving electrodes without altering the material for the insulating layer and the thickness thereof, and minimizes (or reduces or prevents) the signal delay, thereby enhancing the display image quality.

According to one embodiment of the present invention, an electron emission device includes a first substrate and a second substrate facing the first substrate. A first electrode and a second electrode are formed on the first substrate and insulated from each other. Electron emission regions are electrically connected to at least one of the first electrode or the second electrode. A phosphor layer is formed on the second substrate. An anode electrode is formed on a surface of the phosphor layer. An area of the electron emission regions is an emission area, and at least one of the first electrode or the second electrode includes a pair of line portions spaced apart from each other in parallel while interposing the emission area therebetween and a connector traversing the emission area to interconnect the pair of line portions.

According to another embodiment of the present invention, an electron emission device includes a first substrate and a second substrate facing the first substrate. A first electrode and a second electrode are formed on the first substrate and insulated from each other. Electron emission regions are electrically connected to at least one of the first electrode or the second electrode. A phosphor layer is formed on the second substrate. An anode electrode is formed on a surface of the phosphor layer. An area of the electron emission regions is a first emission area, and at least one of the first electrode or the second electrode has an opening portion formed between the first emission area and a second emission area and located in a direction of a length of the at least one of the first electrode or the second electrode to provide a non-overlapped area between the first and second electrodes.

The emission area is located at the center of the cross area of the first and second electrodes, and at least one of the first electrode or the second electrode has a subsidiary electrode formed on an entire surface thereof except for a portion of the surface corresponding to the emission area.

According to another embodiment of the present invention, an electron emission device includes a first substrate and a second substrate facing the first substrate. A first electrode and a second electrode are formed on the first substrate and insulated from each other. Electron emission regions are electrically connected to at least one of the first electrode or the second electrode. A phosphor layer is formed on the second substrate. An anode electrode is formed on a surface of the phosphor layer. Each of the first and second electrodes includes a line portion and effective portions protruded from the line portion to correspond to respective pixels defined by the first substrate such that the line portions of the first and second electrodes cross each other and the corresponding effective portions of the first and second electrodes are overlapped with each other, and the electron emission regions are located at the effective portions of the first electrode or the second electrode.

The electron emission regions include carbon nanotube, graphite, graphite nanofiber, diamond, diamond-like carbon, $C_{60}$, and/or silicon nanowire.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain embodiments of the present invention are shown and described, by way of illustration. As those skilled in the art would recognize, the described embodiments may be modified in various ways, all without departing from the spirit or scope of the present invention. Accordingly, the drawings and description are to be regarded as illustrative in nature, rather than restrictive.

Figure 1:
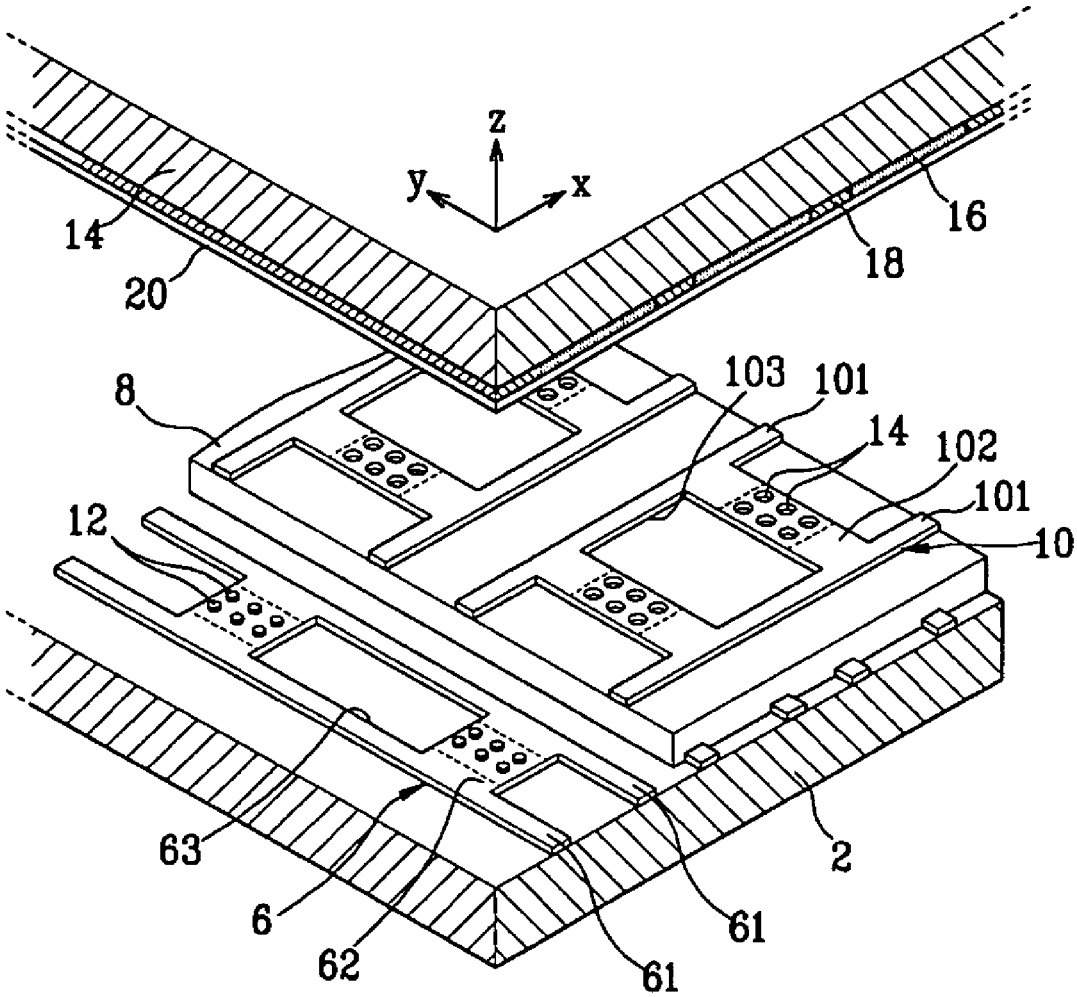
FIG. 1 is a partial exploded perspective view of an electron emission device according to a first embodiment of the present invention.
Figure 2:
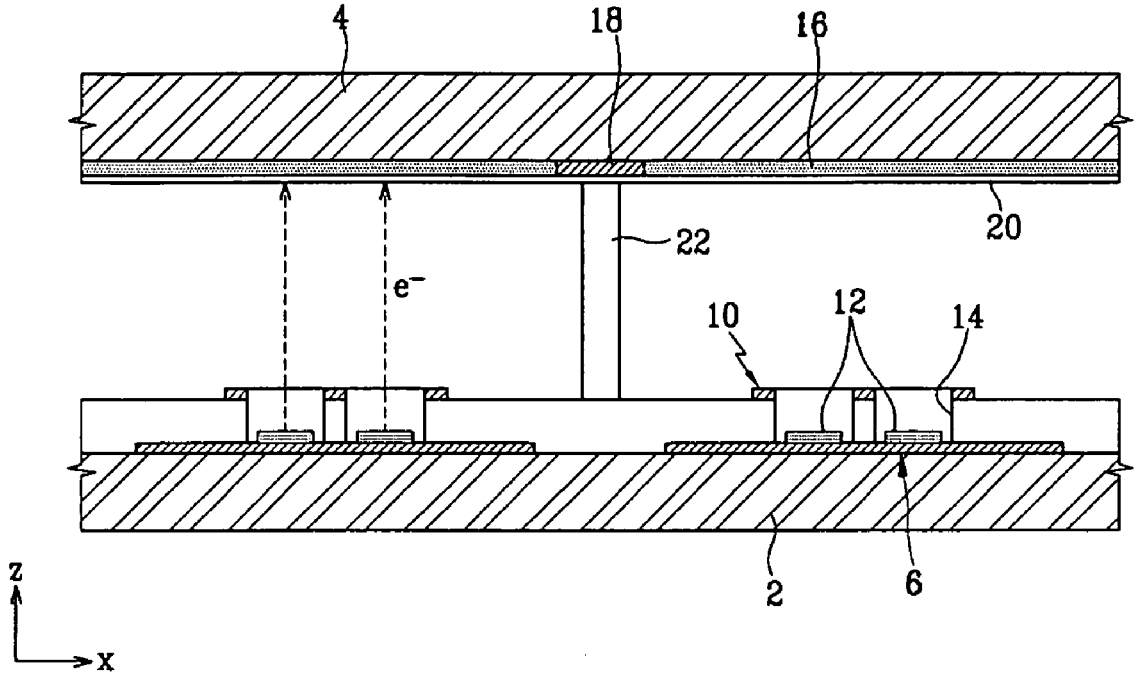
FIG. 2 is a partial sectional view of the electron emission device shown in FIG. 1.
Figure 3:
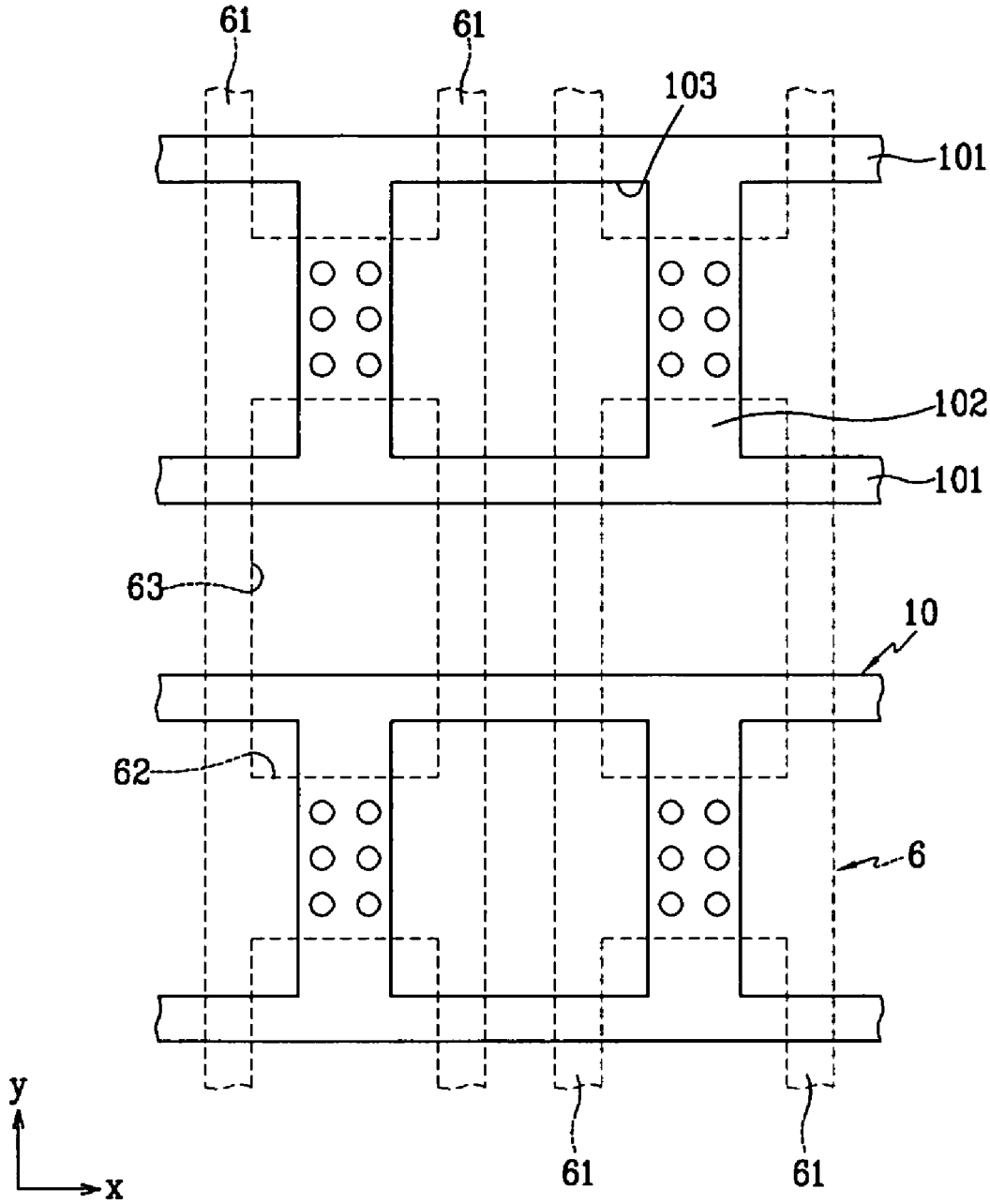
FIGS. 3 to 6 are partial plan views of structures formed on the first substrate shown in FIG. 1.

FIGS. 1 and 2 are a partial exploded perspective view and a partial sectional view of an electron emission device according to a first embodiment of the present invention, and FIG. 3 is a partial plan view of a first substrate structure shown in FIG. 1.

As shown in FIGS. 1, 2, and 3, the electron emission device includes first and second substrates 2 and 4 facing each other in parallel with a distance therebetween (wherein the distance between the first and second substrates 2 and 4 may be predetermined). An electron emission structure is provided on the first substrate 2 to emit electrons, and a light emission or display structure is provided on the second substrate 4 to emit visible light due to the electrons to thereby display the desired images.

First electrodes 6 are formed on the first substrate 2 as cathode electrodes in a direction of the first substrate 2 (in the direction of the y-axis of FIGS. 1 and 3), and an insulating layer 8 is formed on the entire surface of the first substrate 2 such that it covers the first electrodes 6. Second electrodes 10 are formed on the insulating layer 8 as gate electrodes such that they proceed perpendicular to the first electrodes 6 (in the direction of the x-axis of FIGS. 1, 2, and 3).

In this embodiment, when a cross area of the first and second electrodes 6 and 10 correspond to a pixel, one or more electron emission regions 12 are formed on the first electrodes 6 to correspond to each pixel, and opening portions 14 are formed at the insulating layer 8 and the second electrode 10 to correspond to the respective electron emission regions 12 to expose the electron emission regions 12 on the first substrate 2.

The electron emission regions 12 are formed with a material for emitting electrons when an electric field is applied thereto under a vacuum atmosphere, such as a carbonaceous material and/or a nanometer (nm) size material. In one embodiment, the electron emission regions 12 are formed with carbon nanotube, graphite, graphite nanofiber, diamond, diamond-like carbon, $C_{60}$ (fullerene) silicon nanowire, or a combination thereof. The electron emission regions 12 may be formed through screen printing, direct growth, chemical vapor deposition, and/or sputtering.

Phosphor and black layers 16 and 18 are formed on a surface of the second substrate 4 facing the first substrate 2, and an anode electrode 20 is formed on the phosphor and black layers 16 and 18 with an aluminum-like metallic material. The anode electrode 20 receives a high voltage required for accelerating electron beams from the electron emission regions 12, and reflects the visible rays radiated from the phosphor layers 16 to the first substrate 2 toward the side of the second substrate 4, thereby heightening the screen luminance.

Alternatively, an anode electrode may be formed with a transparent conductive material such as indium tin oxide (ITO), instead of the metallic material. In this alternative case, the anode electrode may be patterned on a surface of the phosphor and black layers directed toward the second substrate with a plurality of portions (i.e., the anode electrode is between the second substrate and the phosphor and black layers).

Figure 4:
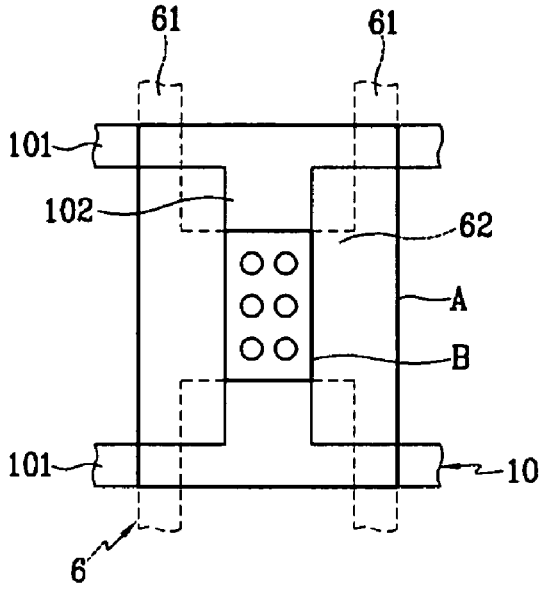

As shown in FIG. 4, a rectangular-shaped area where a first electrode 6 and a second electrode 10 cross each other such that opposing sides of the first electrode 6 form a pair of long sides while opposing sides of the second electrode 10 form a pair of short sides. In FIG. 4, the pair of long sides and the pair of short sides are shown as a cross area A of the first and second electrodes 6 and 10. Furthermore, an area where the electron emission regions 12 are located to substantially emit electrons during the device operation is shown as an emission area B.

The emission area B is smaller in size than the cross area A. In one embodiment, the emission area B is located at the center of the cross area A.

In the case where the emission area B is placed within the cross area A of the first and second electrodes 6 and 10, the first electrode 6 is formed with a pair of line portions 61 placed at opposing sides thereof and a connector 62 traversing the emission area B to interconnect the pair of line portions 61. The second electrode 10 is also formed with a pair of line portions 101 placed at opposing sides thereof, and a connector 102 traversing the emission area B to interconnect the pair of line portions 101.

Figure 5:
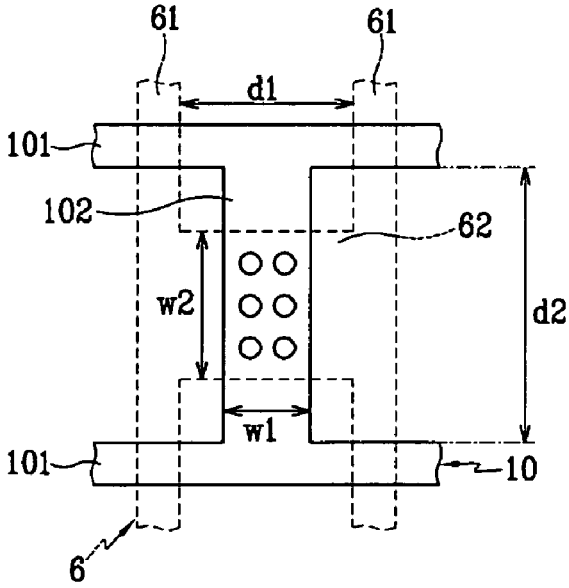

As shown in FIG. 5, the distance d1 between the line portions 61 of the first electrode 6 is larger than the width w1 of the emission area B in the direction of the width of the first electrode 6, and the connector 62 of the first electrode 6 in one embodiment has the same width as the width w2 of the emission area B in the direction of the length of the first electrode 6.

The distance d2 between the line portions 101 of the second electrode 10 is established to be larger than the width w2 of the emission area B in the direction of the width of the second electrode 10, and the connector 102 of the second electrode 10 in one embodiment has the same width as the width w1 of the emission area B in the direction of the length of the second electrode 10.

Figure 6:
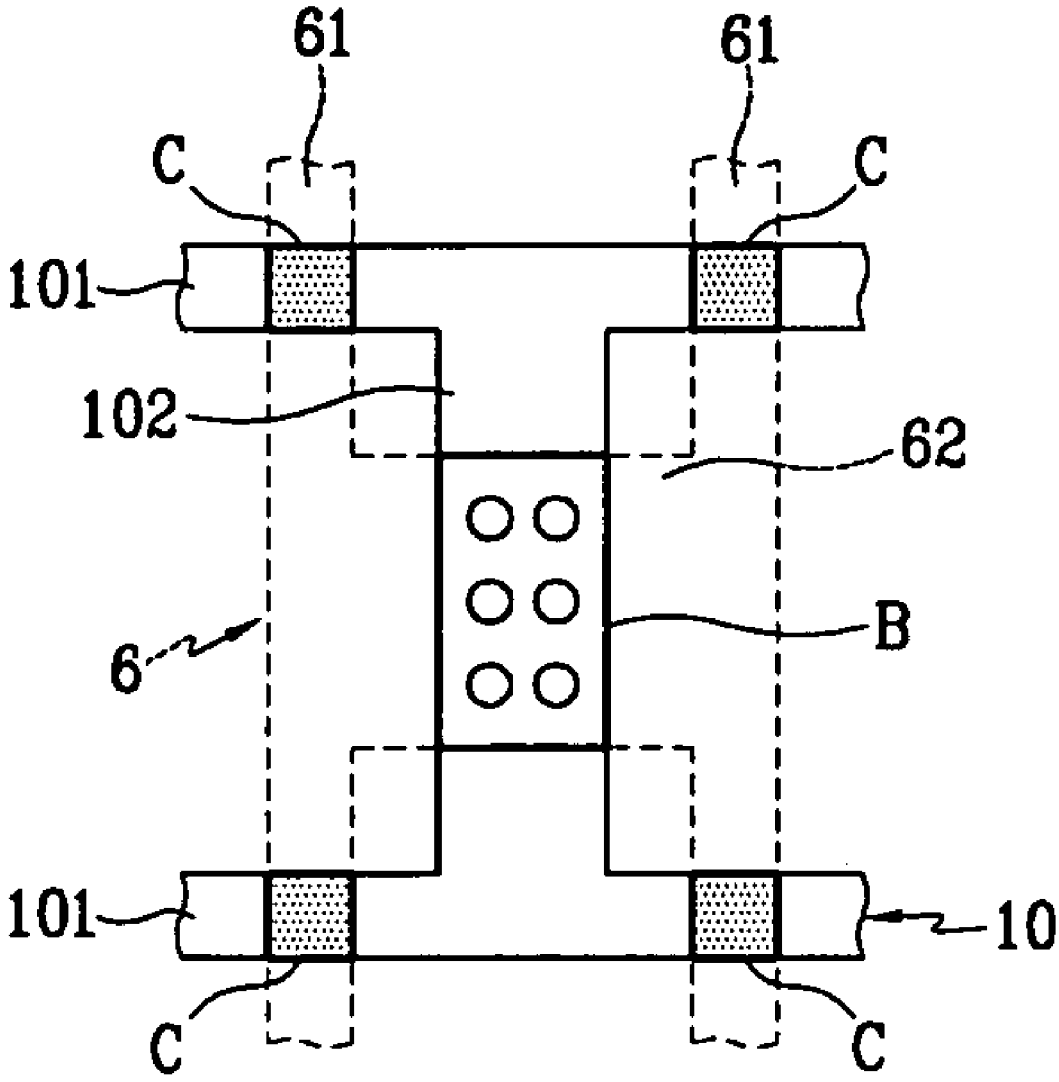

When the first and second electrodes 6 and 10 are structured in a shape like the above, as shown in FIG. 6, there are only four domains C in the cross area A where the line portions 61 of the first electrode 6 and the line portions 101 of the second electrode 10 are overlapped with each other, and a domain of the emission area B where the electron emission regions 12 are located.

Referring back to FIGS. 1 and 3 and considering the shape of the first and second electrodes 6 and 10, the first electrode 6 has opening portions 63 between the respective emission areas B in the longitudinal direction, and the second electrode 10 also has opening portions 103 between the respective emission areas B in the longitudinal direction. The opening portions 63 of the first electrode 6 and the opening portions 103 of the second electrode 10 form non-overlapped regions.

With the opening portion 63 of the first electrode 6, the length thereof in the direction of the width of the first electrode 6 (in the x-axis direction thereof) is larger than the width of the emission area B in the x-axis direction, and the length thereof in the longitudinal direction of the first electrode 6 (in the y-axis direction thereof) is in one embodiment the same as the distance between the two neighboring emission areas B in the y-axis direction.

With the opening portion 103 of the second electrode 10, the length thereof in the direction of the width of the second electrode 10 (in the y-axis direction thereof) is larger than the width of the emission area B in the y-axis direction, and the length thereof in the longitudinal direction of the second electrode 10 (in the x-axis direction) in one embodiment is the same as the distance between the two neighboring emission areas in the x-axis direction.

With the above structure, the first electrode 6 receives driving voltages through a pair of line portions 61, and supplies electric currents required for emitting electrons to the electron emission regions 12 placed at the emission area B. The second electrode 10 also receives driving voltages through a pair of line portions 101 to form electric fields around the electron emission regions 12 due to the voltage difference thereof from the first electrode 6 at the emission area B.

Figure 7:
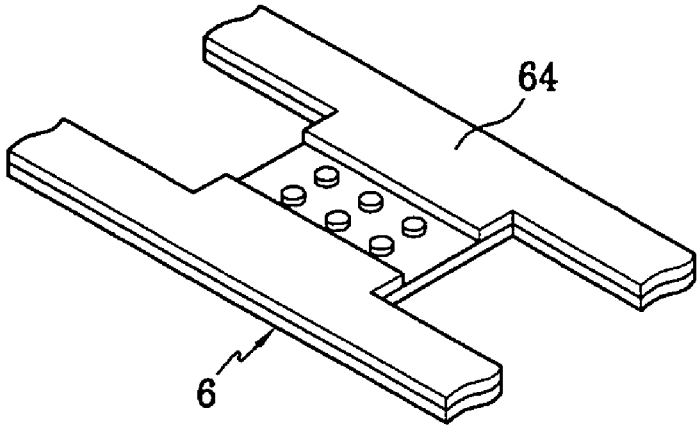
FIG. 7 is a partial cut perspective view of a first electrode for an electron emission device according to one embodiment of the present invention.
Figure 8:
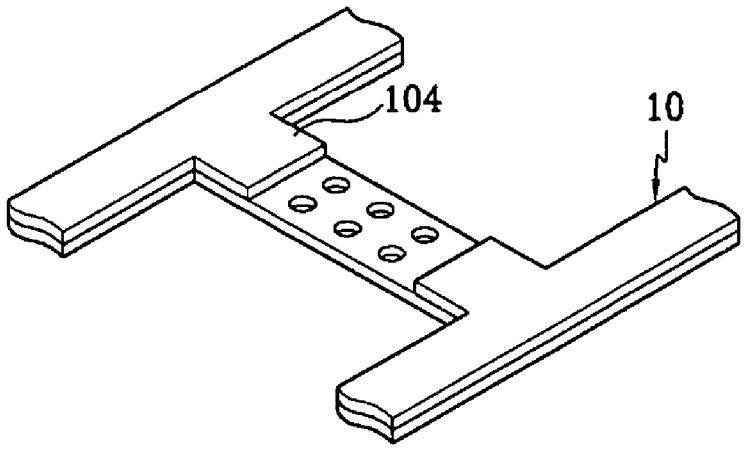
FIG. 8 is a partial cut perspective view of a second electrode for an electron emission device according one embodiment of the present invention.

As shown in FIG. 7 and according one embodiment of the invention, a subsidiary electrode 64 is formed on the entire top surface of the first electrode 6 except for the emission area B thereof with a high conductive metallic material. As shown in FIG. 8 and according to one embodiment of the present invention, a subsidiary electrode 104 is formed on the entire top surface of the second electrode 10 except for the emission area B thereof.

The first electrode 6 is formed with ITO having light transmittance, and the second electrode 10 is formed with chromium (Cr). The subsidiary electrodes 64 and 104 are formed with a low resistance material such as silver (Ag) and/or aluminum (Al) to lower the resistance of the first and second electrodes 6 and 10, thereby minimizing (or reducing or preventing) a voltage drop and a signal delay.

Furthermore, the line portions 61 and the connector 62 of the first electrode 6 may be formed with the same material such as ITO, or with different materials. Similarly, the lines portions 101 and the connector 102 of the second electrode 10 may also be formed with the same material or other (or different) suitable materials.

Spacers 22 shown in FIG. 2 are mounted between the first and second substrates 2 and 4, which are sealed to each other at the peripheries thereof. The inner space between the substrates 2 and 4 is evacuated to form a vacuum (or to be in a vacuum state), thereby constructing an electron emission device. The spacers 22 are located corresponding to the non-light emitting area of the black layer 18. For convenience of explanation, only one spacer 22 is shown in FIG. 2.

The above-structured electron emission device is driven by supplying voltages (which may be predetermined) to the first electrodes 6, the second electrodes 10, and the anode electrode 20 from the outside. Driving voltages with a voltage difference of several to several tens of volts are applied to the first and second electrodes 6 and 10, and a positive (+) voltage of several hundreds to several thousands of volts is applied to the anode electrode 20.

Accordingly, electric fields are formed around the electron emission regions 12 at the pixels where the voltage difference between the first and second electrodes 6 and 10 exceeds a threshold value, and electrons are emitted from those electron emission regions 12. The emitted electrons are attracted by the high voltage applied to the anode electrode 20, and collide against the corresponding phosphor layers 16 to emit light.

With the formation of the opening portions 63 and 103 at the first and second electrodes 6 and 10, the resistance is increased, but the capacitance is significantly lowered due to the reduction in the overlapped area of the two electrodes 6 and 10, thereby effectively minimizing (or reducing or preventing) the signal delay.

Figure 9:
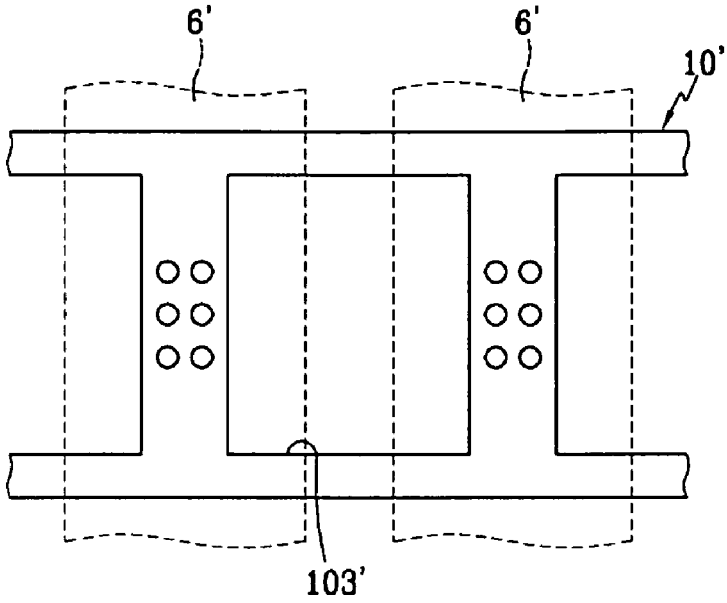
FIG. 9 is a partial plan view of a structure formed on a first substrate of an electron emission device according to a second embodiment of the present invention.
Figure 10:
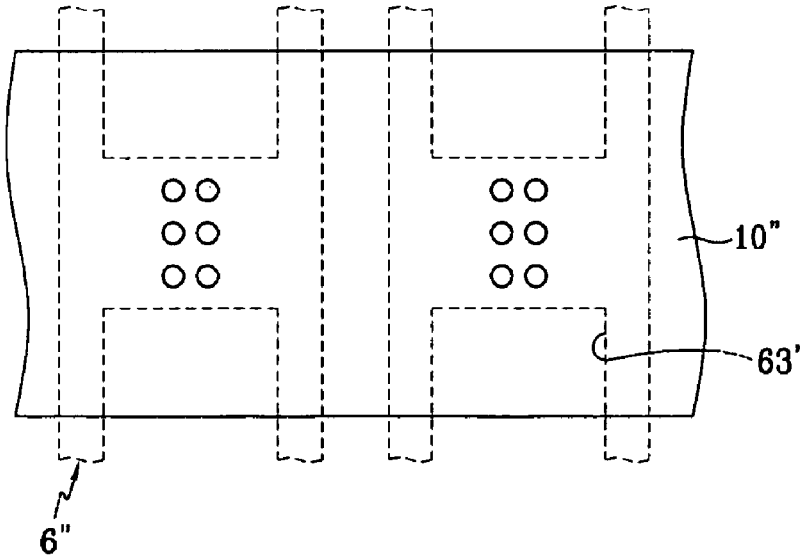
FIG. 10 is a partial plan view of a structure formed on a first substrate of an electron emission device according to a third embodiment of the present invention.

FIGS. 9 and 10 are partial plan views of first substrate structures of electron emission devices according to second and third embodiments of the present invention.

As shown in FIG. 9, with the electron emission device according to the second embodiment of the present invention, first electrodes 6' are stripe-patterned with a width (which may be predetermined), and second electrodes 10' have substantially the same structure as that of the second electrodes 10 of the first embodiment. In the second embodiment, the overlapped area of the first and second electrodes 6' and 10' is reduced (as compared with stripe-patterned second electrodes not having opening portions 103') due to the opening portions 103' of the second electrodes 10', thereby lowering the parasitic capacitance between the first and second electrodes 6' and 10'.

As shown in FIG. 10, with the electron emission device according to the third embodiment of the present invention, second electrodes 10" are stripe-patterned with a width (which may be predetermined), and first electrodes 6" have substantially the same structure as that of the first electrodes 6 of the first embodiment. In the third embodiment, the overlapped area of the first and second electrodes 6" and 10" is reduced (as compared with stripe-patterned first electrodes not having opening portions 63') due to the opening portions 63' of the first electrode 6", thereby lowering the parasitic capacitance between the first and second electrodes 6" and 10".

Figure 11:
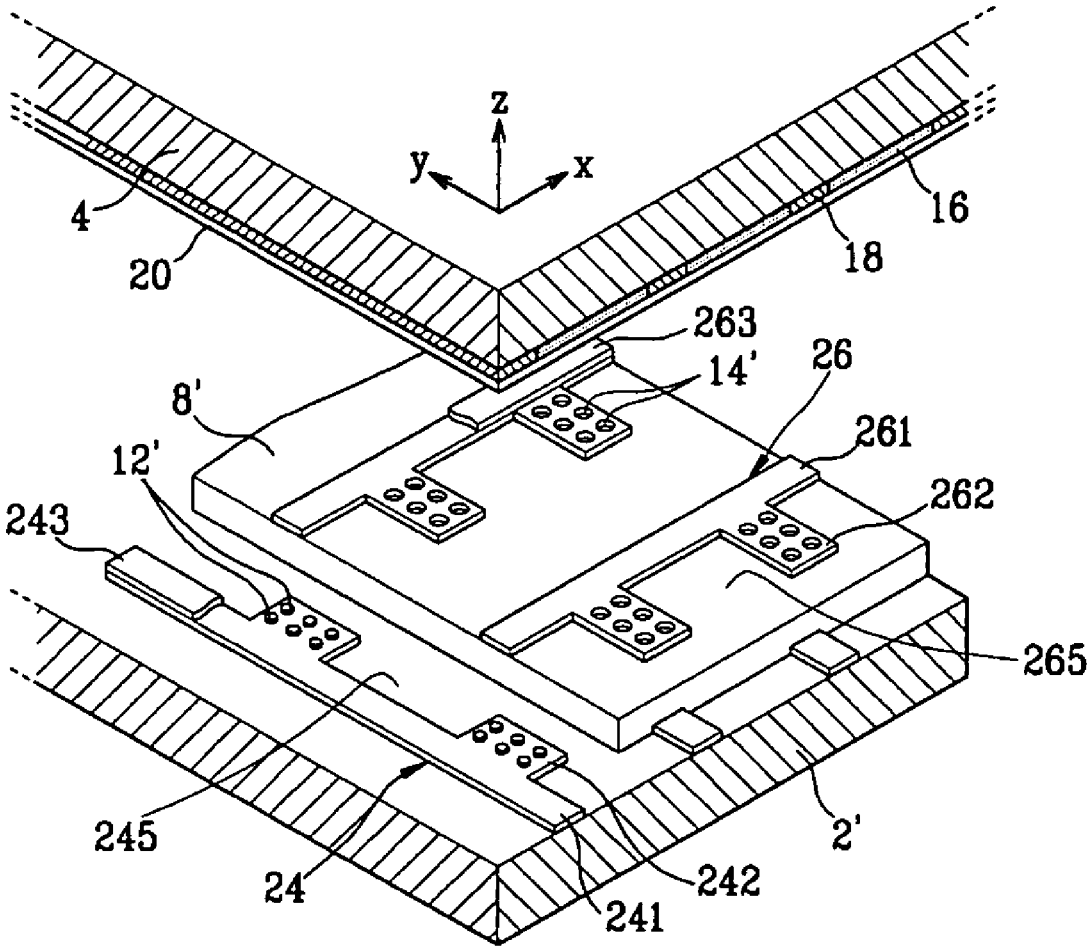
FIG. 11 is a partial exploded perspective view of an electron emission device according to a fourth embodiment of the present invention.
Figure 12:
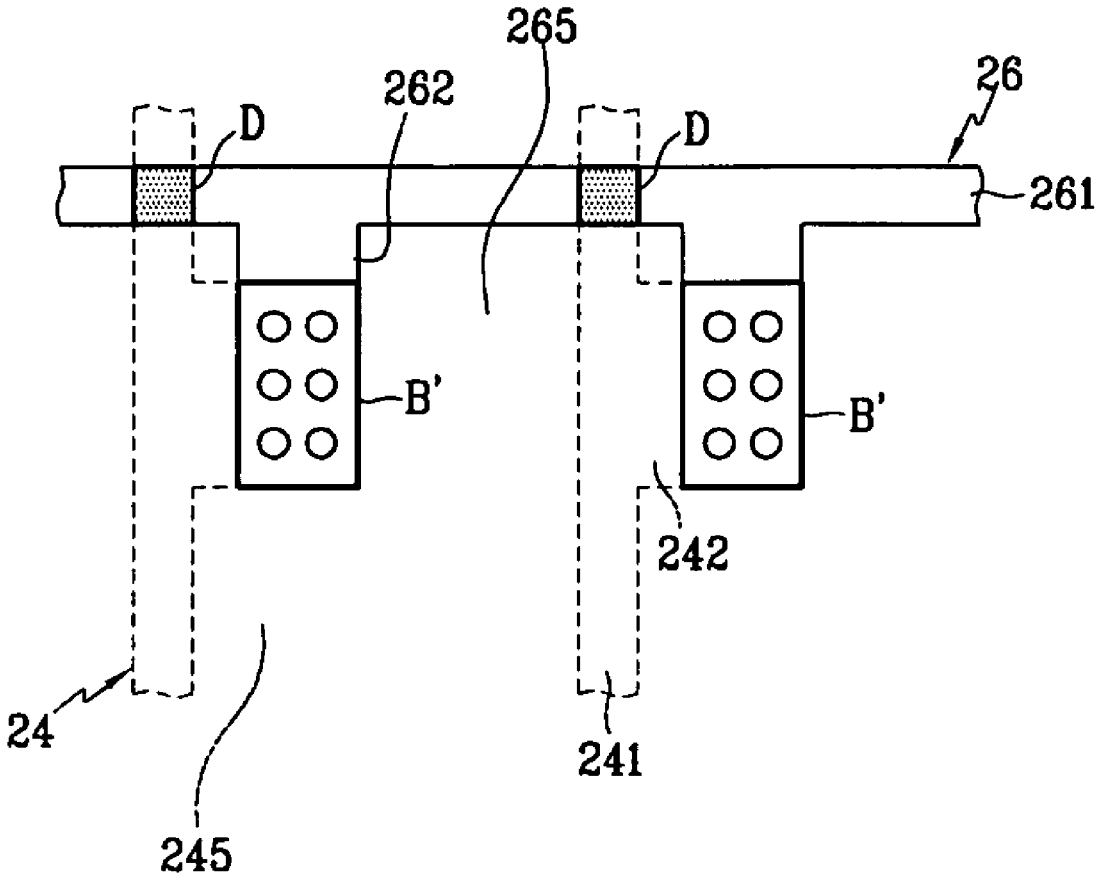
FIG. 12 is a partial plan view of a structure formed on the first substrate shown in FIG. 11.

FIG. 11 is a partial exploded perspective view of an electron emission device according to a fourth embodiment of the present invention, and FIG. 12 is a partial plan view of a structure formed on a first substrate shown in FIG. 11.

As shown in FIGS. 11 and 12, first electrodes 24 are formed each with a line portion 241 proceeding in a direction of a first substrate 2' (in the direction of the y-axis of FIG. 11), and effective portions 242 protruded from the line portion 241 to correspond to respective pixels defined by the first substrate 2'. Second electrodes 26 are formed on an insulating layer 8' each with a line portion 261 crossing (or proceeding perpendicular) to the line portion 241 of the first electrode 24 (in the direction of the x-axis of FIG. 11), and effective portions 262 protruded from the line portion 261 toward the effective portions 242 of a corresponding one of the first electrodes 24 and overlapped with those effective portions 242.

One or more electron emission regions 12' are formed on the respective effective portions 241 of a first electrode 24, and opening portions 14' are formed at the insulating layer 8 and the effective portions 262 of a corresponding second electrode 26 to correspond to the respective electron emission regions 12' to expose the electron emission regions 12' on the first substrate 2'. In this way, the effective portions 242 and 262 of the first and second electrodes 24 and 26 form emission areas where a substantial emission of electrons is made.

Opening areas 245 are formed between the effective portions 242 of the first electrode 24, and opening areas 265 are formed between the effective portions 262 of the second electrode 26. In the present application, an opening area may refer to the closed opening area surrounded by the line portions of the first and/or second electrodes and the connectors as with the structures of the first, second, and/or third embodiments, or to the partially not closed opening area formed by the line portions and the effective portions of the first and/or second electrodes as with the structure according to the present embodiment.

Additionally, in one embodiment, subsidiary electrodes 243 and 263 are formed on the line portion 241 of the first electrode 24 and the line portion 261 of the second electrode 26, respectively. The subsidiary electrodes 243 and 263 can compensate for the increase in resistance of the first and second electrodes 24 and 26 due to the reduction in line width.

As shown in FIG. 12, the first and second electrodes 24 and 26 at each pixel are overlapped with each other at a domain D where the line portions 241 and 261 of the two electrodes 24 and 26 cross each other, and a domain B' of the emission area where the electron emission regions 12' are located. The overlapping of the first and second electrodes 24 and 26 is not made at other domains between the first and second electrodes 24 and 26 at each pixel due to the presence of the opening areas 245 and 265.

Accordingly, with the electron emission device according to the present embodiment, the resistance is increased due to the reduction in line width of the first and second electrodes 24 and 26, but the capacitance is significantly lowered due to the reduction in the overlapped area of the two electrodes, thereby effectively minimizing (or reducing or preventing) a signal delay.

Figure 13:
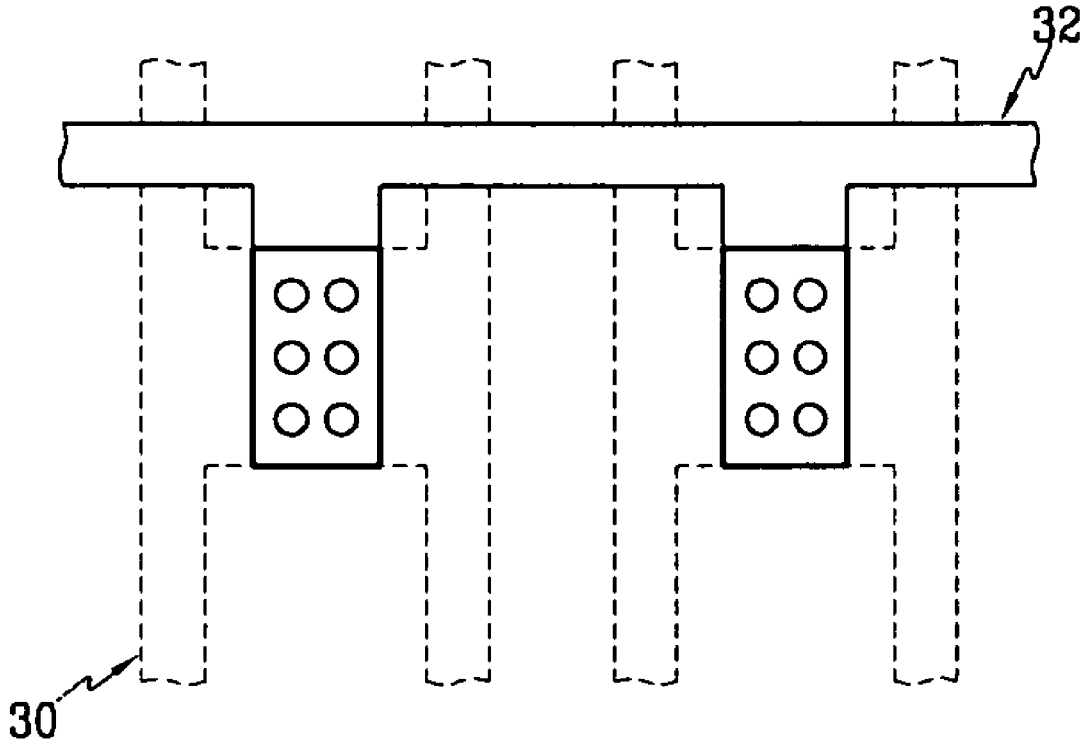
FIG. 13 is a partial plan view of a structure formed on a first substrate of an electron emission device according to a fifth embodiment of the present invention.
Figure 14:
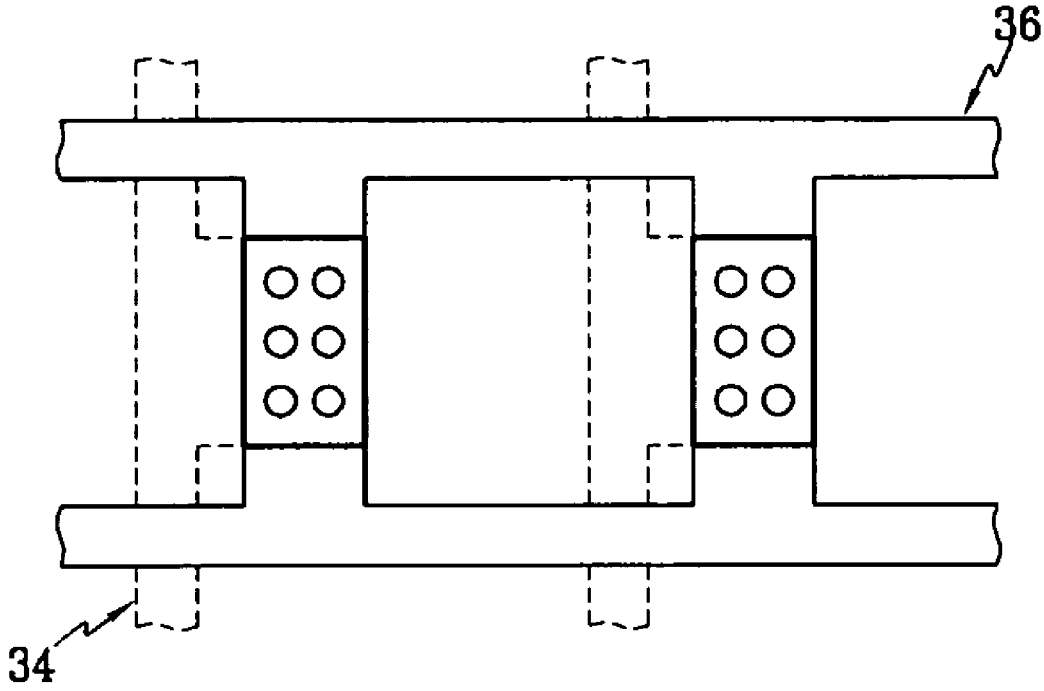
FIG. 14 is a partial plan view of a structure formed on a first substrate of an electron emission device according to a sixth embodiment of the present invention.

FIGS. 13 and 14 are partial plan views of electron emission devices according to fifth and sixth embodiments of the present invention, schematically illustrating electrodes formed on a first electrode. The electrodes according to the fifth and sixth embodiments are formed with combinations in shape of the electrodes according to the previous embodiments.

Referring to FIG. 13, first and second electrodes 30 and 32 of the fifth embodiment have substantially the same shape of the first electrode 6 shown in FIG. 1 and substantially the same shape of the second electrode 26 shown in FIG. 11, respectively. The first and second electrodes 34 and 36 shown in FIG. 14 have substantially the same shape of the first electrode 24 shown in FIG. 11 and substantially the same shape of the second electrode 10 shown in FIG. 1, respectively.

That is, with the present invention, the first and second electrodes may be formed with any suitable shapes provided that when they are placed on the first substrate, they are not partially overlapped with each other at the cross area thereof.

With the electron emission device according to the present invention, an overlapped area of a first electrode and a second electrode is reduced due to the shape of the first and second electrodes, thereby significantly lowering the capacitance. Consequently, when driving signals (or voltages) are applied to the first and second electrodes to control the emission of electrons for the respective pixels, a signal delay is effectively minimized (or reduced or prevented), thereby enhancing a display image quality.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a first substrate and a second substrate facing the first substrate;

a first electrode and a second electrode, the first and second electrodes being on the first substrate and insulated from each other;

electron emission regions electrically connected to at least one of the first electrode or the second electrode;

a phosphor layer on the second substrate; and an anode electrode on a surface of the phosphor layer, wherein an area of the electron emission regions is an emission area, and wherein at least one of the first electrode or the second electrode comprises a pair of line portions spaced apart from each other in parallel while interposing the emission area therebetween and a connector traversing the emission area to interconnect the pair of line portions, and wherein at least one of the first electrode or the second electrode has a subsidiary electrode on an entire surface thereof except for a portion of the surface corresponding to the emission area.

2. The electron emission device of claim 1, wherein the first electrode is formed with the pair of line portions and the connector, and a distance between the pair of line portions is larger than a width of the emission area in a direction of a width of the first electrode.

3. The electron emission device of claim 2, wherein the connector of the first electrode has a width substantially equal to the width of the emission area in a direction of a length of the first electrode.

4. The electron emission device of claim 1, wherein the second electrode is formed with the pair of line portions and the connector, and-a distance between the pair of line portions is larger than a width of the emission area in a direction of a width of the second electrode.

5. The electron emission device of claim 4, wherein the connector of the second electrode has a width substantially equal to the width of the emission area in a direction of a length of the second electrode.

6. The electron emission device of claim 1, wherein the emission area is located at the center of a cross area of the first and second electrodes.

7. The electron emission device of claim 1, wherein the electron emission regions comprise a material selected from the group consisting of carbon nanotube, graphite, graphite nanofiber, diamond, diamond-like carbon, $C_{60}$, silicon nanowire, and combinations thereof.

8. An electron emission device comprising:

a first substrate and a second substrates facing the first substrate;

a first electrode and a second electrode, the first and second electrodes being formed on the first substrate and insulated from each other;

electron emission regions electrically connected to at least one of the first electrode or the second electrode;

a phosphor layer on the second substrate; and an anode electrode on a surface of the phosphor layer, wherein an area of the electron emission regions is a first emission area, and wherein at least one of the first electrode or the second electrode has an opening portion formed between the first emission area and a second emission area and located in a direction of a length of the at least one of the first electrode or the second electrode to provide a non-overlapped area between the first and second electrodes, and wherein at least one of the first electrode or the second electrode has a subsidiary electrode on an entire surface thereof except for a portion of the surface corresponding to the emission area.

9. The electron emission device of claim 8, wherein the first electrode has the opening portion between the first and second emission areas, and a width of the opening portion in a direction of a width of the first electrode is larger than a width of the emission area in the direction of the width of the first electrode.

10. The electron emission device of claim 9, wherein the opening portion of the first electrode is structured such that a length of the opening portion in a direction of a length of the first electrode is substantially equal to a distance between the first and second emission areas in a longitudinal direction.

11. The electron emission device of claim 8, wherein the second electrode has the opening portion between the first and second emission areas, and a width of the opening portion in a direction of a width of the second electrode is larger than a width of the emission area in the direction of the width of the second electrode.

12. The electron emission device of claim 11, wherein the opening portion of the second electrode is structured such that a length of the opening portion in a direction of a length of the second electrode is substantially equal to the distance between the first and second emission areas in a longitudinal direction.

13. The electron emission device of claim 8, wherein the emission area is located at the center of a cross area of the first and second electrodes.

14. The electron emission device of claim 8, wherein the electron emission regions comprise a material selected from the group consisting of carbon nanotube, graphite, graphite nanofiber, diamond, diamond-like carbon, $C_{60}$, silicon nanowire, and combinations thereof.

15. An electron emission device comprising:

a first substrate and a second substrate facing the first substrate;

a first electrode and a second electrode, the first and second electrodes being formed on the first substrate and insulated from each other;

electron emission regions electrically connected to at least one of the first electrode or the second electrode;

a phosphor layer on the second substrate; and an anode electrode on a surface of the phosphor layer, wherein each of the first and second electrodes comprises a line portion and effective portions protruded from the line portion to correspond to respective pixels defined by the first substrate such that the line portions of the first and second electrodes cross each other and the corresponding effective portions of the first and second electrodes are overlapped with each other, and wherein the electron emission regions are located at the effective portions of the first electrode or the second electrode, and wherein each of the first and second electrodes has a subsidiary electrode on a surface of the line portion thereof.

16. The electron emission device of claim 15, wherein the electron emission regions comprise a material selected from the group consisting of carbon nanotube, graphite, graphite nanofiber, diamond, diamond-like carbon, $C_{60}$, silicon nanowire, and combinations thereof.

17. An electron emission device, comprising:

a first substrate and a second substrates facing the first substrate;

a first electrode and a second electrode, the first and second electrodes being on the first substrate and insulated from each other;

electron emission regions electrically connected to at least one of the first electrode or the second electrode;

a phosphor layer on the second substrate; and an anode electrode on a surface of the phosphor layer, wherein an area of the electron emission regions is an emission area, and wherein the first and second electrodes form a non-overlapped area within a cross area of the first and second electrodes except for a portion of the cross area corresponding to the emission area.

* * * * *

UNITED STATES PATENT AND TRADEMARK OFFICE

CERTIFICATE OF CORRECTION

PATENT NO. : 7,579,763 B2
APPLICATION NO. : 11/391753
DATED : August 25, 2009
INVENTOR(S) : Sang-Hyuck Ahn It is certified that error appears in the above-identified patent and that said Letters Patent is hereby corrected as shown below:

In the Claims

Column 9, Claim 4, line 10 Delete "-" before "a"

Column 9, Claim 8, line 26 Delete "substrates" Insert --substrate--

Column 10, Claim 17, line 46 Delete "substrates" Insert --substrate--

Signed and Sealed this
Nineteenth Day of April, 2011

David J. Kappos

David J. Kappos
*Director of the United States Patent and Trademark Office*